United States Patent [19]

Furmanak

[11] Patent Number: 5,005,320

[45] Date of Patent: Apr. 9, 1991

[54] METHOD AND APPARATUS FOR TAPERING AN END OF AN ELONGATED OBJECT

[75] Inventor: Robert J. Furmanak, Wilmington, Del.

[73] Assignee: E. I. Du Pont de Nemours and Company, Wilmington, Del.

[21] Appl. No.: 502,010

[22] Filed: Mar. 30, 1990

[51] Int. Cl.[5] ..... B24B 19/00; B24B 5/00

[52] U.S. Cl. ..... 51/131.1; 51/227 H

[58] Field of Search ..... 51/130, 131.1, 227 R, 51/227 H, 125

[56] References Cited

U.S. PATENT DOCUMENTS 1,287,224 12/1918 Canary ..... 51/131.1

1,464,203 8/1923 Hutchinson ..... 51/227 H 1,851,229 3/1932 Wright ..... 51/131.1

2,264,593 12/1941 Stainbrook ..... 51/227 H 4,831,784 5/1989 Takahashi ..... 51/131.1

*Primary Examiner*—Frederick R. Schmidt

*Assistant Examiner*—Blynn Shideler

*Attorney, Agent, or Firm*—James H. Dautremont

[57] ABSTRACT

An elongated object in need of tapering at an end thereof is secured by holder means which comprises a ball bearing that rotates the elongated object and the holder means together by means of contact with a rotating grooved ring disposed upon a rotating polishing surface, wherein the rotating ring and the holder means are restrained from translational motion by a guiding means.

2 Claims, 5 Drawing Sheets

METHOD AND APPARATUS FOR TAPERING AN END OF AN ELONGATED OBJECT

BACKGROUND OF THE INVENTION

1. Field of the Invention

This invention is related to the process of tapering an object, and more specifically, an elongated object.

2. Description of the Prior Art

There are many methods and apparatus useful for tapering objects. Fiber optics involves the transmission of light through transparent fibers of glass. These optical fibers can carry light over distances ranging from a few inches to more than 100 miles. Some individual fibers measure less than 0.001 inch in diameter.

Optical fibers have an extremely pure core of glass and are surrounded by a durable covering called cladding. Light from a laser, light-emitting diode, light bulb, or some other light-emitting device enters one end of the optical fiber. As the light travels through the core, it is typically kept inside it by the cladding. The cladding is designed in such a way that it bends inward light rays that strike its inside surface. At the other end of the fiber, the light is received by a photosensitive device.

There are two basic kinds of optical fibers—single-mode fibers and multi-mode fibers. Single-mode fibers are generally used for long-distance transmissions. They have extremely small cores (typically 8–9 microns in diameter), and they accept light only along the axis of the fibers. As a result, single-mode fibers require the use of special lasers as a light source, and they need to be precisely connected to the laser, to other fibers in the system, and to the photosensitive detector. Multi-mode fibers have cores larger than those of single-mode fibers (typically 50–60 microns in diameter), and they can use more types of light sources and cheaper connectors than can single-mode fibers, but they cannot be used over long distances.

These optical fibers have a number of uses. In an optical circuit application, lasers transmit coded messages by flashing on and off at extremely high speeds. The messages travel through optical waveguides longitudinally formed in photopolymeric sheets where they may be added, divided, switched and/or modulated in a manner analogous to the way electrical signals are processed in a printed circuit board. The termination point of the optical waveguides must be precisely connected by means of optical fibers to photosensitive interpreting devices that decode the messages and convert them back into the original form of the signal. Two significant advantages in using this optical circuitry to transmit data are the speed and lack of susceptibility to electrical noise.

However, a large problem in inexpensively achieving satisfactory optical circuits has been the troublesome interconnection between the waveguide within the photopolymeric web and the optical fiber. The center of the optical fiber must be precisely aligned, both axially and translationally, with the waveguide to minimize energy loss. In order to aid in this alignment, typically, the waveguide will stop just prior to reaching the edge of the web. There, a smaller diameter rectangular hole will be extended to reach the edge of the web. The longitudinal and translational axes of this hole are centered along those of the solid waveguide. The rectangular hole acts as a guide to precisely align the optical fiber with the center of the waveguide and to provide the fiber a snug fit into the circuit.

This arrangement while utilitarian is at once problematic. In order to effectively transfer light signals at the waveguide/optical fiber interface, the fiber must be cleaved transverse to its longitudinal axis such that its face is substantially flat. The process of cleaving the glass fiber leaves a sharp outer edge around the circumference of the cut. The diameter of the fiber is marginally larger (approximately 5 microns) than that of the rectangular hole so that the soft photopolymer walls must give slightly to accommodate the fiber's entry. As an operator attempts to insert the fiber into the end of the waveguide, often with the aid of a microscope, the sharp edges of the glass fiber slice away tiny shavings from the walls of the soft photopolymer. These shavings are pushed ahead of the fiber during the insertion process and block or otherwise interfere with the light path between the waveguide and optical fiber.

The prior art has dealt with various schemes to eliminate production of these troublesome shavings that disturb the light path at the waveguide/optical fiber interface. Most attempts have sought to taper the edges of the glass fiber around its circumference so that when it is threaded only a smooth bore encounters the soft photopolymer that makes up the waveguide walls. The primary problem with this approach is that the face of the optical fiber must remain flat for effective light transfer. The size of the glass fiber is small and it is indeed a challenge to taper or bevel its edges and leave the face of it intact.

U.S. Pat. No. 4,754,576 teaches a method of tapering using a translatable and rotatable microscope for viewing the tapering process and a fixed angled rotating pad to perform the taper. The problem with such a method is that it involves the time consuming process of setting a series of micrometers and an operator to be present to watch and limit the grinding operation. The fixed angle of the rotating polishing pad does not allow the operator to choose a specific angle of taper. And the manner of tapering is performed so that an additional heating step can take place to form a lens at the end of the fiber.

It is an object of the instant invention to provide a preferred solution to the general tapering problem for elongated objects.

It is also an object of this invention to provide a simple method of tapering an optical fiber, while leaving the active portion of its face flat for optimum light transfer.

It is an additional object of this invention to provide a method of adjusting the angle of taper of an optical fiber within a desirable range.

It is a further object of this invention to provide a fast method of achieving a desired taper to the optical fiber.

It is, moreover, an object of this invention to provide substantially uniform tapering around the circumference of the glass fiber.

It is a still further object of this invention to free the operator from the task of constantly monitoring the tapering operation to ensure a satisfactory result.

SUMMARY OF THE INVENTION

The present invention provides a conveniently demountable apparatus, for use in conjunction with a standard polishing machine, for tapering an end of an elongated object comprising:

a. a holder assembly means for holding said elongated object;

b. a translatable bearing centered on said holder assembly means;

c. a ring having a substantially flat bottom surface and a top surface having angled surfaces thereon upon which said bearing will rotate;

d. means for guiding said holder and said ring during a tapering operation.

DETAILED DESCRIPTION OF THE INVENTION

Figure 1:
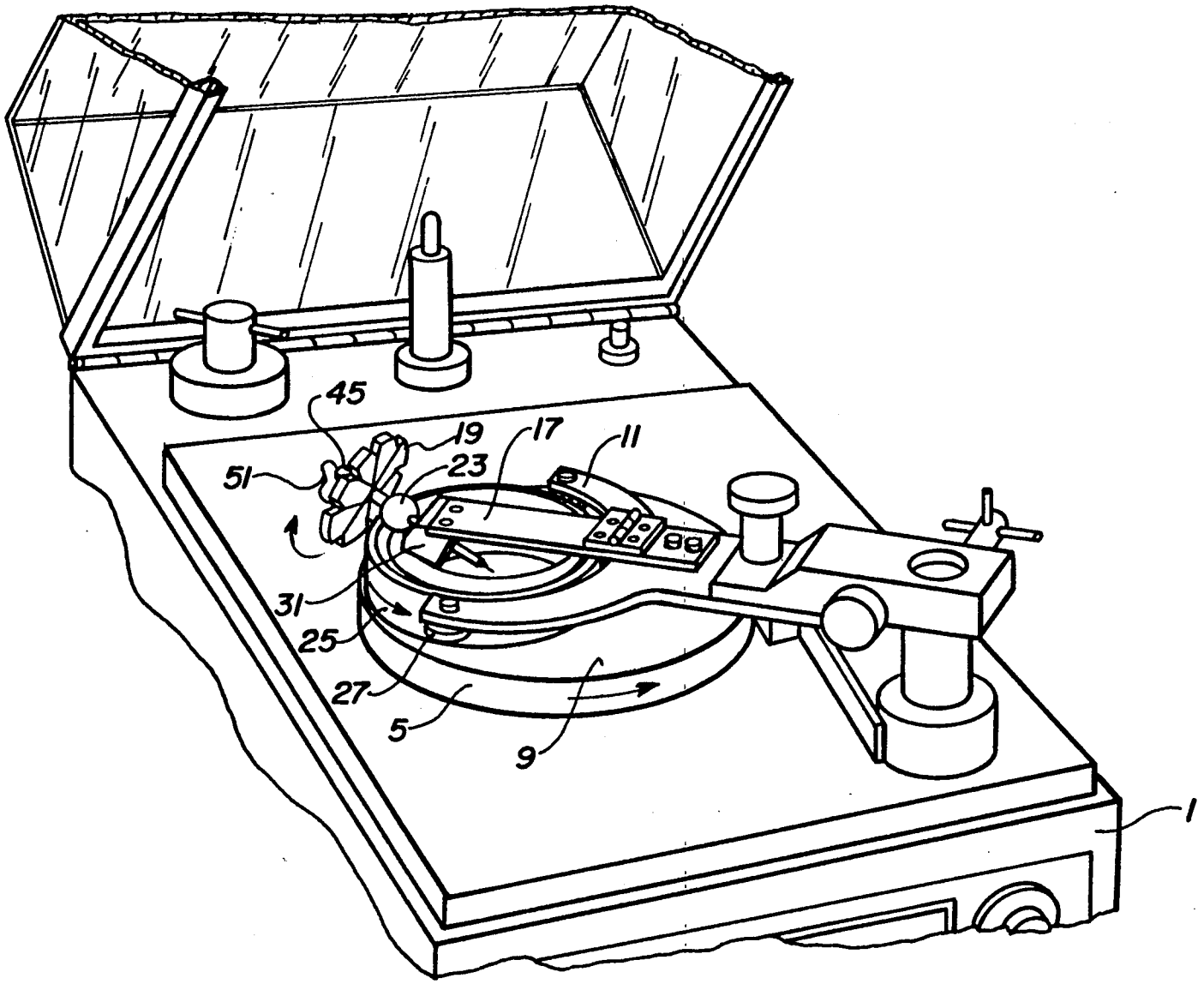
FIG. 1 is a perspective view of a portion of a Logitech TM Precision Lapping and Polishing Machine equipped with a mechanism comprising a preferred embodiment of the present invention for bevel polishing optical fiber ends.
Figure 2:
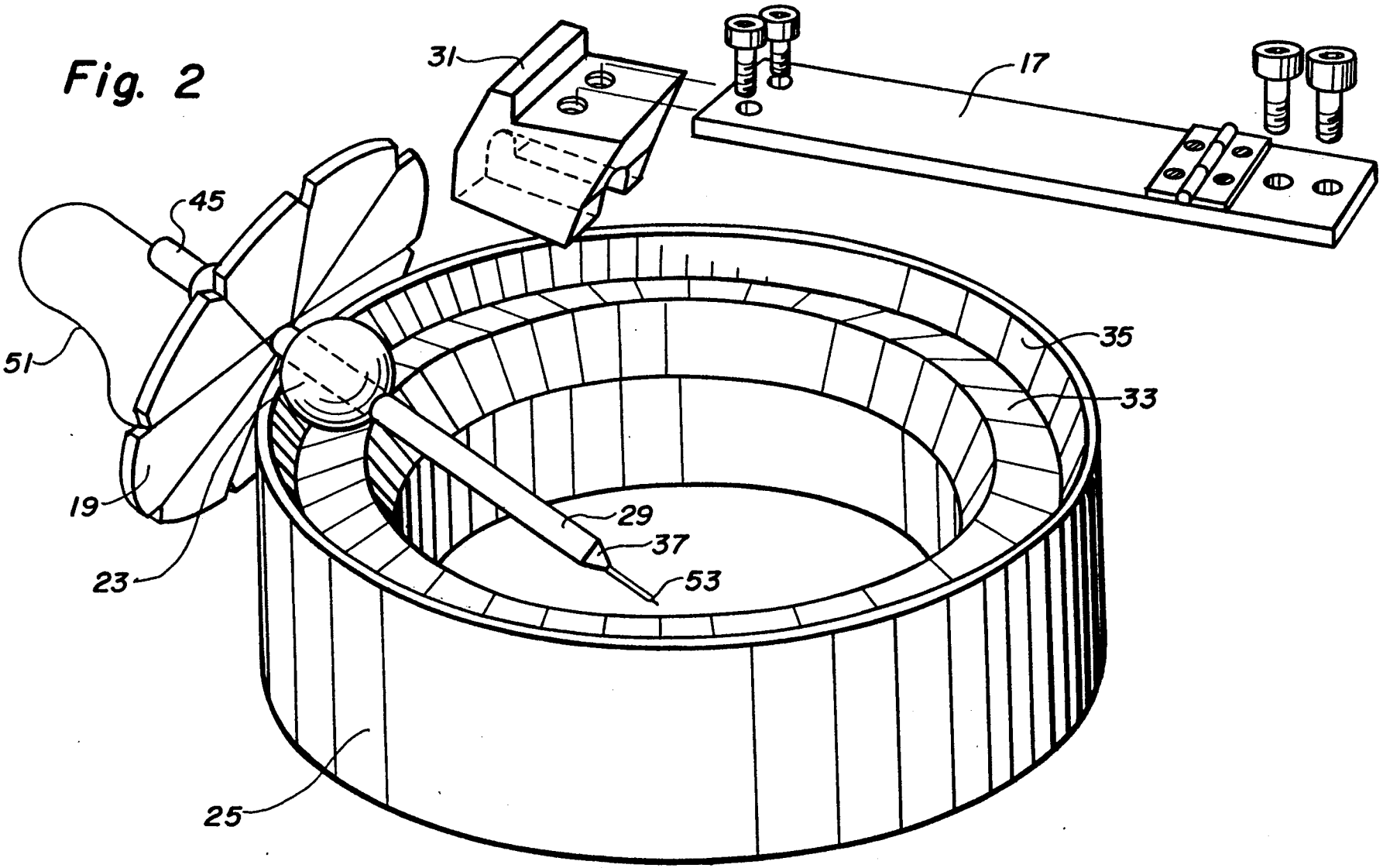
FIG. 2 is an enlarged, partially exploded, view of the assembled components of said mechanism.

Referring now to the drawing, an encased glass fiber 51 is first stripped of its casing and cladding material by means of a wire stripper to an appropriate length, e.g. one and a half inches. The fiber 53 is wiped clean using a cloth and methanol. The fiber is then inspected using at least a 10× magnification to ensure that no dirt is present. Next, the clean fiber is cleaved with a diamond edged blade to yield a substantially horizontal cut of the glass fiber exposed from the cladding to a desired length, e.g. 520 microns. The scrap piece of glass may be discarded.

Figure 3:
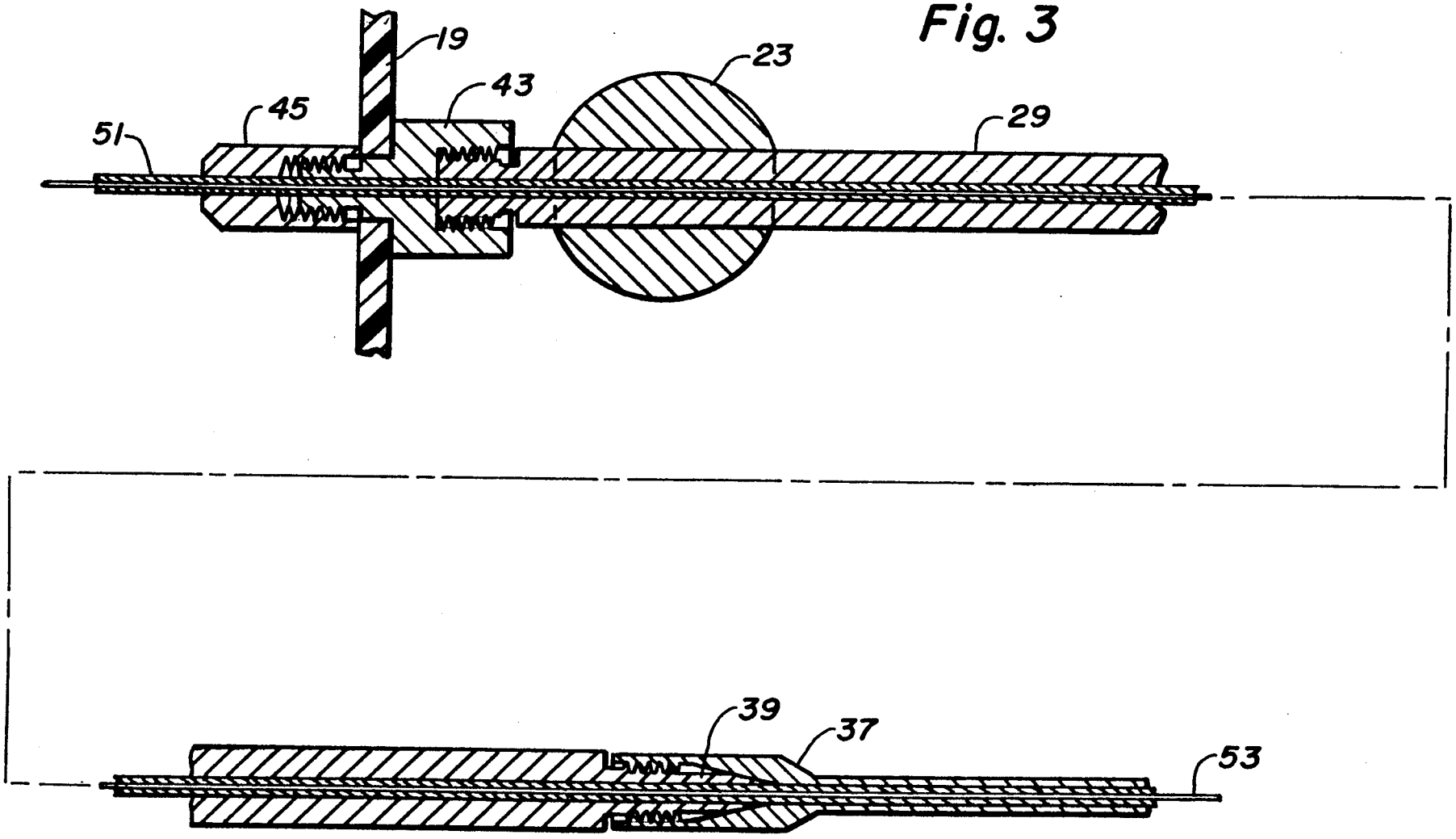
FIG. 3 is a vertical sectional view through the optical fiber holding assembly.
Figure 4:
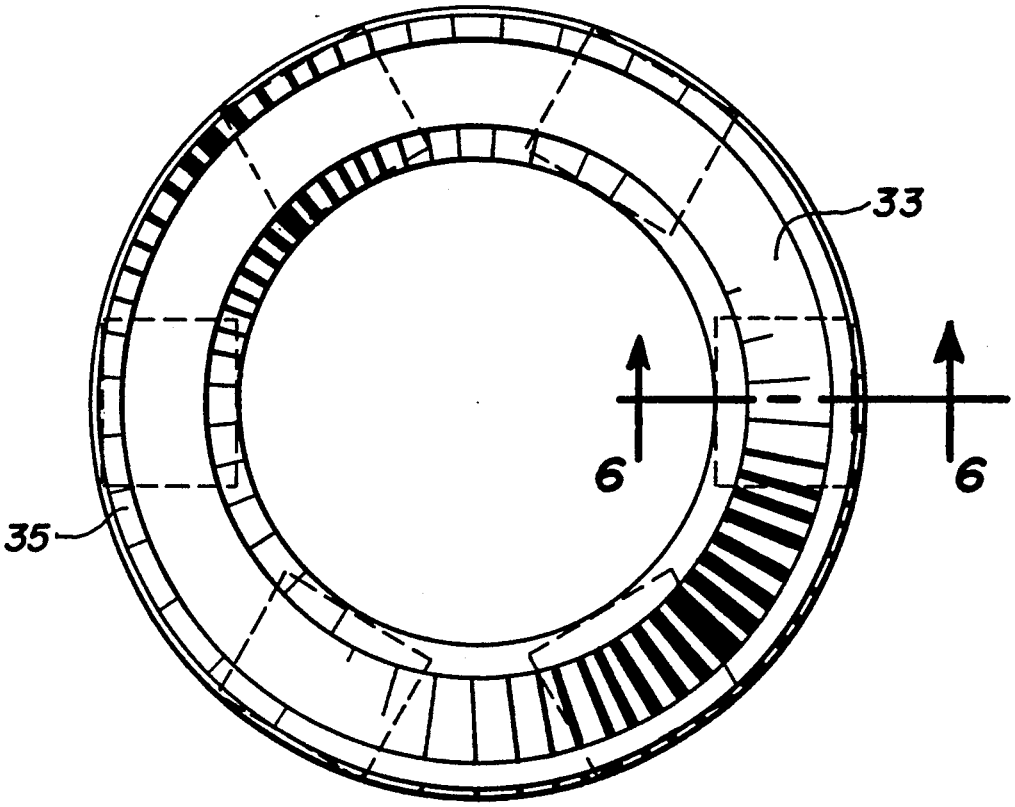
FIG. 4 is a top plan view of the ring portion of the mechanism.

The fiber 53 may then be threaded through a fiber holder assembly having component pieces comprising: a cap 45, a grooved take-up wheel 19, a shoulder 43, a stem 29 and a needle nosed end portion 37, FIG. 3. These various pieces screw together to make up the fiber holder assembly.

After threading, a section of optical fiber 53 should protrude through the needled nosed end portion 37 of the holder assembly to permit tapering to occur. The inner diameter of the needled nosed end portion should be sized so as to substantially eliminate side-to-side wobble of the fiber in the holder assembly during tapering. The position of optical fiber 53 may then be axially fixed inside the fiber holder by screwing end 37 onto chuck 39 at the base of stem 29 so as to tighten it about the cladding on the fiber. The balance of the cladded fiber that cannot be fed into the fiber holder may be conveniently wound around grooved take-up wheel 19. A translatable ball bearing 23 is friction mounted along stem 29 and fixed at a desired position. Rotation of the ballbearing will then rotate the fiber holder as well. A change in location of the ballbearing along the stem translates into a change in the angle of bevel for the optical fiber during tapering.

The fiber holder assembly is placed diagonally onto metal ring 25 such that the ballbearing lies inside angled tracks 35 and 33 that combine to form a raceway around the top surface of the ring. The needled nosed portion 37 of the fiber holder assembly is pointed toward the bottom center of ring 25 and grooved take-up wheel 19, shoulder 43 and cap 45 are outside the top edge of the metal ring. The ballbearing should be free to rotate upon the raceway of the metal ring without interference from the grooved take-up wheel.

Care must be taken in both selecting the size of the ballbearing and the angles of the tracks 33 and 35. Once a particular sized ballbearing is chosen, tracks 33 and 35 should be angled such that, during the tapering operation, their respective points of contact with the ballbearing interact are positioned to produce a substantially uniform spin of the ballbearing. As the ballbearing rotates upon the raceway, two imaginary circles will be inscribed on the surface of the ballbearing corresponding to the points of contact with lower track 33 and upper track 35, respectively. Applicant has discovered that if the ratio of the radius of the upper circle to the radius of the lower circle approaches an integer, then negligible wobbling will occur. For example, if a ¾" ballbearing is used, track 33 should be angled at about 111 degrees and track 35 should be angled at about 21 degrees measuring counterclockwise from a zero degree horizontal line.

Figure 5:
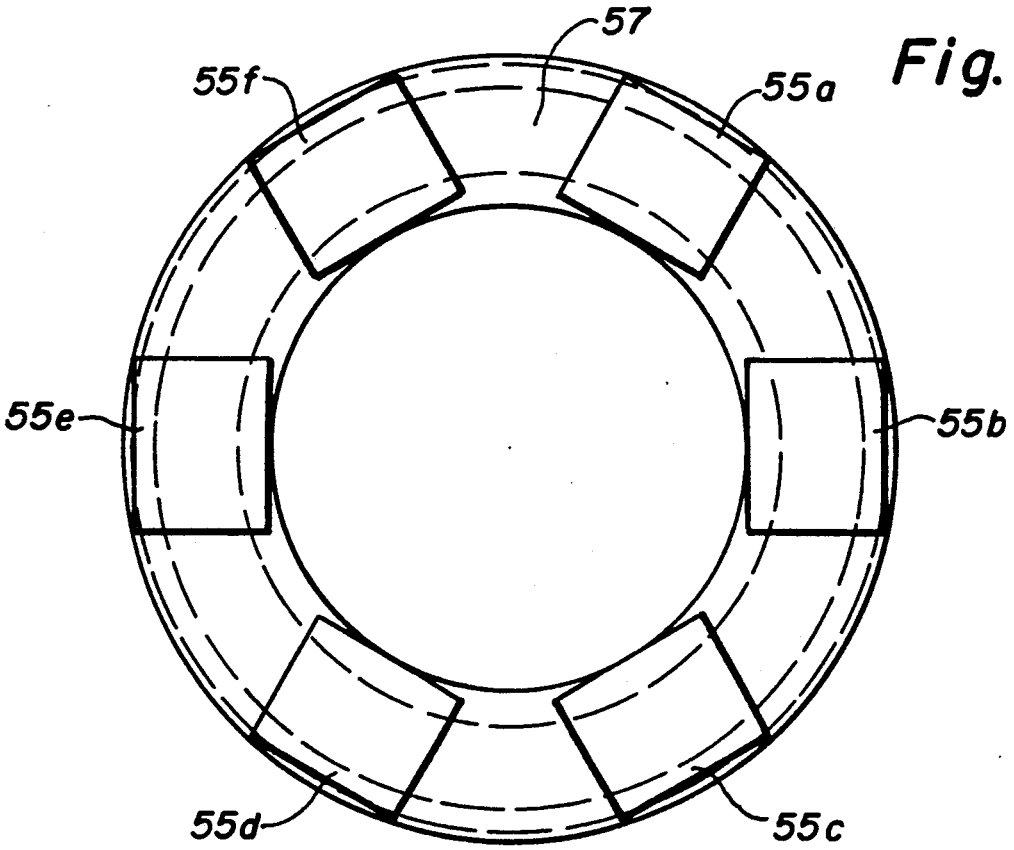
FIG. 5 is a bottom plan view of the ring of FIG. 4 showing the glass foot pads on the under-side of the ring.
Figure 6:
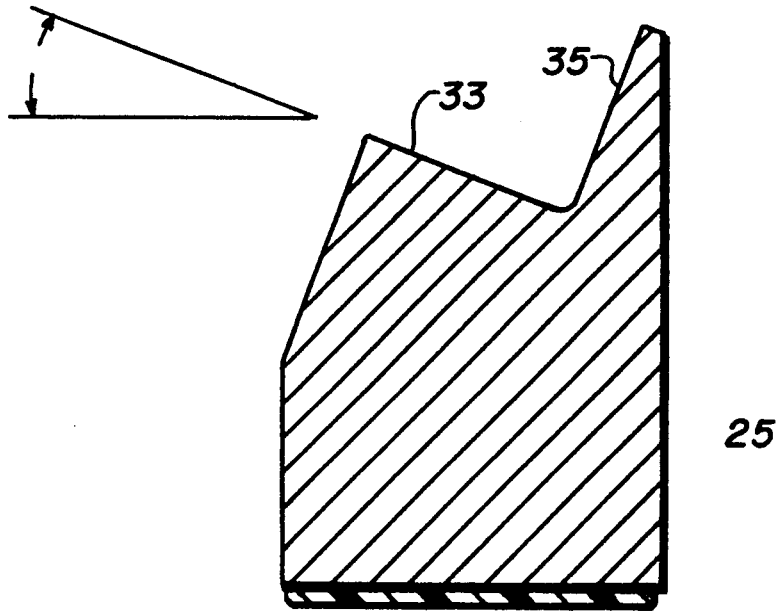
FIG. 6 is an enlarged sectional view of the ring taken on the line 6—6 of FIG. 4 showing a preferred profile of the operative surfaces of the ring.

Rectangular sections of microslide 55*a–f* (FIG. 5) are glued to the underside of the ring to lessen wear during the polishing operation. The ring is placed onto a diamond dust impregnated polishing pad 9 mounted onto a rotatable plate 5 of a standard polishing machine 1 (e.g. Logitech PM2A). The ring is held in place by a half circle roller drive arm 11 which is fixed to the frame (FIG. 1). A hinged tongue 17 having a guide 31 extends from roller drive arm 11 and grips the stem of the fiber holder below the ballbearing. The constraint of the guide allows the tip of the fiber to rest lightly (approximately two or more grams of pressure) on the polishing pad and allows the holder to spin within its grasp, while prohibiting the holder's side-to-side motion.

During a polishing operation, polishing pad 9 spins counterclockwise which causes metal ring 25 also to spin counterclockwise inside roller drive arm 11 about drive arm rollers 27*a* and 27*b*. The position of the metal ring on the polishing pad in combination with the ring's smaller radius causes it to rotate faster than the polishing pad. The friction of the raceway moving beneath the ballbearing causes the fiber holder assembly to spin in a clockwise direction, opposite that of the metal ring. The circumferential edge of glass fiber 53 is evenly tapered as it rotates on the polishing pad while the polishing pad simultaneously spins in the opposite direction beneath it.

Figure 7:
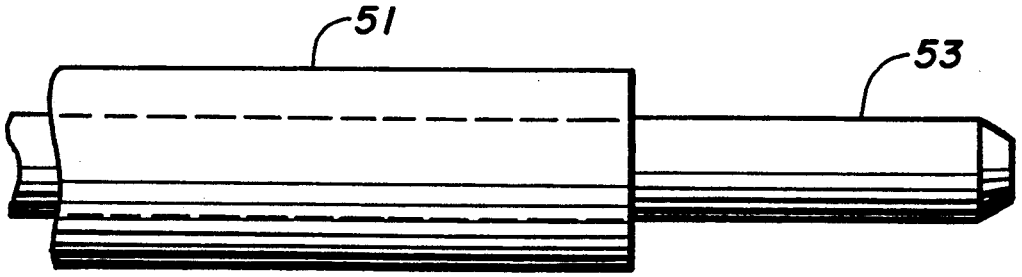
FIG. 7 is an enlarged view of the end portion of an optical fiber after a bevel forming operation has been accomplished in accordance with the instant invention.

In this manner, beveling of the optical fiber takes place. The optical fiber is always angled in its contact with the pad such that the center of its face remains flat for optimum light transfer (FIG. 7).

It is to be understood that the specific embodiments described above are provided as examples of a best mode of the invention, but are not intended to limit the fair scope of the invention, which is defined by the appended claims.

What is claimed is:

1. A conveniently demountable apparatus, for use is conjunction with a standard polishing machine, for tapering an end of an optical fiber comprising:

a. a holder assembly means for holding said optical fiber;

b. a translatable ball bearing friction mounted and centered on the longitudinal axis of said holder assembly means, said bearing being translatable along the length of said holder assembly means;

c. a ring having a substantially flat bottom surface, said flat bottom surface being disposed to ride on the rotating polishing surface of said polishing machine, and a top surface having a groove thereon upon which said ball bearing rotates, said groove comprising a pair of angled surfaces which are disposed in a V-shape so that as said bearing rotates thereon, the paths of said surfaces' contact points on said ball bearing are substantially circular with the radius of one being substantially an integer multiple of the other; and d. means for guiding said holder assembly means and said ring during a tapering operation so that said ring and said holder means are allowed to rotate but not translate.

2. The apparatus of claim 1, further comprising a plurality of friction-reducing foot pads attached to said bottom surface of said ring, said pads being disposed to rest on the polishing surface of said standard polishing machine during a tapering operation.

* * * * *